US010316653B2

(12) United States Patent
Coffman et al.

(10) Patent No.: US 10,316,653 B2
(45) Date of Patent: Jun. 11, 2019

(54) METHOD FOR CALCULATING AND DISPLAYING OPTIMIZED DRILLING OPERATING PARAMETERS AND FOR CHARACTERIZING DRILLING PERFORMANCE WITH RESPECT TO PERFORMANCE BENCHMARKS

(71) Applicant: Schlumberger Technology Corporation, Sugar land, TX (US)

(72) Inventors: Chunling Gu Coffman, Houston, TX (US); Rustam Isangulov, Katy, TX (US); Oney Erge, Houston, TX (US); John Christian Luppens, Houston, TX (US); Ginger Hildebrand, Houston, TX (US); Wayne Kotovsky, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 746 days.

(21) Appl. No.: 14/538,661

(22) Filed: Nov. 11, 2014

(65) Prior Publication Data

US 2015/0129306 A1 May 14, 2015

Related U.S. Application Data

(60) Provisional application No. 61/903,421, filed on Nov. 13, 2013.

(51) Int. Cl.

| | |
|---|---|
| ***E21B 44/00*** | (2006.01) |
| ***E21B 47/00*** | (2012.01) |
| ***E21B 49/00*** | (2006.01) |

(52) U.S. Cl.

CPC ..... *E21B 49/003* (2013.01); *E21B 44/00* (2013.01); *E21B 47/00* (2013.01)

(58) Field of Classification Search

CPC ..... G01N 21/274; G01R 35/005; G05B 13/042; G05B 13/024; G05B 9/02; G05B 9/03;

(Continued)

(56) References Cited

U.S. PATENT DOCUMENTS

2005/0096847 A1* 5/2005 Huang ..... E21B 44/00 702/9

2006/0272861 A1 12/2006 Hutchinson (Continued)

FOREIGN PATENT DOCUMENTS

| | | |
|---|---|---|
| CA | 2324233 | 10/1999 |
| WO | 2008/070829 | 6/2008 |

(Continued)

OTHER PUBLICATIONS

International search report and written opinion for the equivalent PCT patent application No. PCT/US2014/065152 dated Feb. 27, 2015.

*Primary Examiner* — Charles E Anya
(74) *Attorney, Agent, or Firm* — Alec J. McGinn

(57) ABSTRACT

A method for optimizing drilling includes initializing values of a plurality of drilling operating parameters and drilling response parameters. In a computer, an initial relationship between the plurality of drilling operating parameters and drilling response parameters is determined. A drilling unit to drill a wellbore through subsurface formations. The drilling operating parameters and drilling response parameters are measured during drilling and entered into the computer. A range of values and an optimum value for at least one of the drilling response parameters and at least one of the drilling response parameters is determined in the computer. A display of the at least one of the plurality of drilling operating parameters and the at least one of the drilling response parameters is generated by the computer.

26 Claims, 8 Drawing Sheets

(Continued)

(8 of 8 Drawing Sheet(s) Filed in Color)

(58) Field of Classification Search
CPC ..... E21B 45/00; E21B 47/06; E21B 44/06; E21B 44/00; E21B 49/003
See application file for complete search history.

(56) References Cited

U.S. PATENT DOCUMENTS

| | | | | |
|---|---|---|---|---|
| 2007/0198223 | A1 | 8/2007 | Ella et al. | |
| 2009/0065258 | A1* | 3/2009 | Hamilton | E21B 7/068 175/61 |
| 2009/0132458 | A1* | 5/2009 | Edwards | G06N 5/025 706/50 |
| 2010/0175922 | A1 | 7/2010 | Ignova et al. | |
| 2011/0203846 | A1* | 8/2011 | Degrange | G01V 1/46 175/50 |
| 2011/0220410 | A1 | 9/2011 | Aldred et al. | |
| 2011/0266056 | A1* | 11/2011 | Pop | E21B 49/08 175/50 |
| 2012/0123756 | A1* | 5/2012 | Wang | E21B 44/00 703/2 |
| 2012/0217067 | A1* | 8/2012 | Mebane, III | E21B 44/02 175/57 |
| 2012/0222901 | A1* | 9/2012 | Pei | E21B 49/003 175/56 |
| 2012/0330551 | A1 | 12/2012 | Mitchell et al. | |
| 2013/0025851 | A1* | 1/2013 | Laing | E21B 44/00 166/250.01 |
| 2013/0066471 | A1* | 3/2013 | Wang | G05B 13/00 700/275 |
| 2014/0035578 | A1* | 2/2014 | Song | G01V 3/32 324/309 |
| 2015/0260703 | A1* | 9/2015 | Mitchell | E21B 47/00 73/19.09 |
| 2015/0354336 | A1* | 12/2015 | Maurice | E21B 43/2406 706/12 |

FOREIGN PATENT DOCUMENTS

| | | |
|---|---|---|
| WO | 2011/104504 | 9/2011 |
| WO | 2013/036357 | 3/2013 |

* cited by examiner

METHOD FOR CALCULATING AND DISPLAYING OPTIMIZED DRILLING OPERATING PARAMETERS AND FOR CHARACTERIZING DRILLING PERFORMANCE WITH RESPECT TO PERFORMANCE BENCHMARKS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to the field of construction of wellbores through subsurface formations. More particularly the disclosure relates to methods for automatically calculating and displaying to drilling operations personnel values of drilling operating parameters that may optimize drilling of such wellbores and to characterize drilling performance on a specific wellbore with respect to benchmarks for such performance.

Drilling wellbores through subsurface formations includes suspending a "string" of drill pipe ("drill string") from a drilling unit or similar lifting apparatus and operating a set of drilling tools and rotating a drill bit disposed at the bottom end of the drill string. The drill bit may be rotated by rotating the entire drill string from the surface and/or by operating a motor disposed in the set of drilling tools. The motor may be, for example, operated by the flow of drilling fluid ("mud") through an interior passage in the drill string. The mud leaves the drill string through the drill bit and returns to the surface through an annular space between the drilled wellbore wall and the exterior of the drill string. The returning mud cools and lubricates the drill bit, lifts drill cuttings to the surface and provides hydrostatic pressure to mechanically stabilize the wellbore and prevent fluid under pressure from entering the wellbore from certain permeable formations exposed to the wellbore. The mud may also include materials to create an impermeable barrier ("filter cake") on exposed formations having a lower fluid pressure than the hydrostatic pressure of the mud in the annular space so that mud will not flow into such formations in any substantial amount.

The drilling unit may have controls for selecting "drilling operating parameters." In the present context, the term drilling operating parameters means those parameters which are controllable by the drilling unit operator and/or associated personnel and include, as non-limiting examples, axial force (weight) of the drill string suspended by the drilling unit as applied to the drill bit, rotational speed of the drill bit ("RPM"), the rate at which drilling fluid is pumped into the drill string, and the rotational orientation (toolface—"TF") of the drill string when certain types of motors are used to rotate the drill bit. As a result of the particular values of drilling operating parameters such as the foregoing, the results may include that wellbore will be drilled (lengthened) at a particular rate and along a trajectory (well path) and may result in a particular measured pressure of the drilling fluid at the point of entry into the drill string or proximate thereto, called standpipe pressure ("SPP"). The foregoing are non-limiting examples of "drilling response parameters."

Methods known in the art for optimizing drilling operating parameters are described, for example in the following publications:

International Patent Application Publication No. WO 2011/104504 which discloses a method for optimizing rate of penetration when drilling into a geological formation comprising the steps of: gathering real-time PWD (pressure while drilling) data; acquiring modeled ECD (equivalent circulating density) data; calculating the standard deviation of the differences of said real-time PWD and said modeled ECD data; calculating a predicted maximum tolerable ECD based on the calculated deviation; and determining the rate of penetration of a drill string based on the maximum tolerable ECD of a drilling process. In another aspect the present invention provides a system for optimizing rate of penetration, which system can be used to control the rate of penetration of a drill string based on the maximum tolerable ECD of a drilling process.

Canadian Patent No 2,324,233 which discloses a method of and system for optimizing bit rate of penetration while drilling substantially continuously determine an optimum weight on bit necessary to achieve an optimum bit rate of penetration based upon measured conditions and maintains weight on bit at the optimum weight on bit. As measured conditions change while drilling, the method updates the determination of optimum weight on bit.

International Patent Application Publication No. WO 2008/070829 which discloses a method and apparatus for mechanical specific energy-based drilling operation and/or optimization, comprising detecting mechanical specific energy parameters, utilizing the mechanical specific energy parameters to determine mechanical specific energy, and automatically adjusting drilling operational parameters as a function of the determined mechanical specific energy. A drill string includes interconnected sections of drill pipe, a bottom hole assembly, and a drill bit. The bottom hole assembly may include measurement-while-drilling or wireline conveyed instruments. Downhole measurement-while-drilling or wireline conveyed instruments may be configured for the evaluation of physical properties such as weight-on-bit. While drilling, weight-on-bit and calculate mechanical specific energy data are used to determine subsequent mechanical specific energy.

International Patent Application Publication No. WO 2013/036357 which discloses a method of evaluating drilling performance for a drill bit penetrating subterranean formation comprising: receiving data regarding drilling parameters characterizing ongoing wellbore drilling operations; wherein the drilling data at least includes mechanical specific energy (MSE); selecting a normalization MSE value, $MSE_0$; normalizing MSE with the $MSE_0$ value; and calculating a drilling vibration score, MSER.

SUMMARY

A method according to one aspect for optimizing drilling includes initializing values of a plurality of drilling operating parameters and drilling response parameters. In a computer, an initial relationship between the plurality of drilling operating parameters and drilling response parameters is determined. A drilling unit to drill a wellbore through subsurface formations. The drilling operating parameters and drilling response parameters are measured during drilling and entered into the computer. A range of values and an optimum value for at least one of the drilling response parameters and at least one of the drilling response parameters is determined in the computer. A display of the at least one of the plurality of drilling operating parameters and the at least one of the drilling response parameters is generated by the computer.

Other aspects and advantages will be apparent from the description and claims that follow.

BRIEF DESCRIPTION OF THE DRAWINGS

The patent or application file contains at least one drawing executed in color. Copies of this patent or patent application publication with color drawing(s) will be provided by the Patent and Trademark Office upon request and payment of the necessary fee.

DETAILED DESCRIPTION

Figure 1:
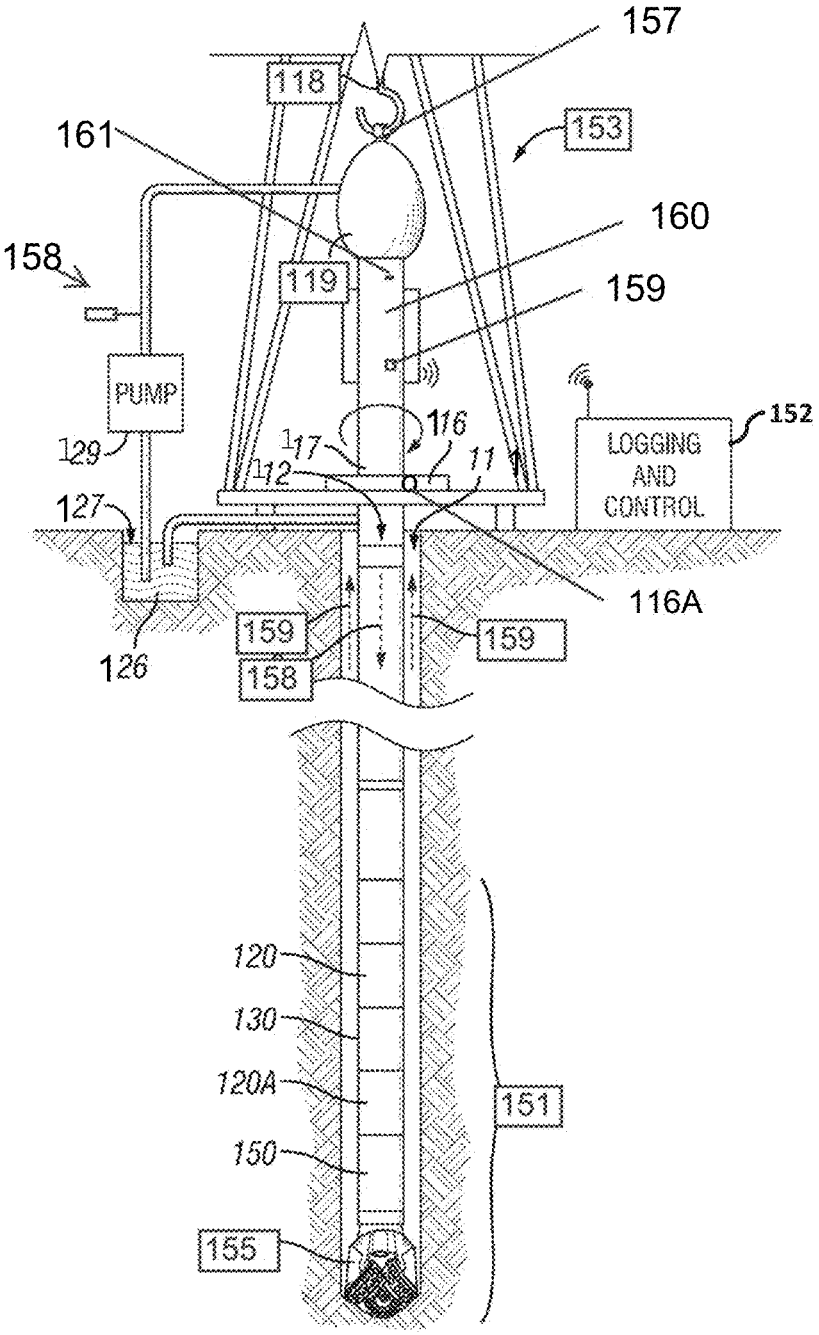
FIG. 1 shows an example drilling and measurement system.

FIG. 1 shows a simplified view of an example drilling and measurement system that may be used in some embodiments. The drilling and measurement system shown in FIG. 1 may be deployed for drilling either onshore or offshore wellbores. In a drilling and measurement system as shown in FIG. 1, a wellbore 111 may be formed in subsurface formations by rotary drilling in a manner that is well known to those skilled in the art. Although the wellbore 111 in FIG. 1 is shown as being drilled substantially straight and vertically, some embodiments may be directionally drilled, i.e. along a selected trajectory in the subsurface.

A drill string 112 is suspended within the wellbore 111 and has a bottom hole assembly (BHA) 151 which includes a drill bit 155 at its lower (distal) end. The surface portion of the drilling and measurement system includes a platform and derrick assembly 153 positioned over the wellbore 111. The platform and derrick assembly 153 may include a rotary table 116, kelly 117, hook 118 and rotary swivel 119 to suspend, axially move and rotate the drill string 112. In a drilling operation, the drill string 112 may be rotated by the rotary table 116 (energized by means not shown), which engages the kelly 117 at the upper end of the drill string 112. Rotational speed of the rotary table 116 and corresponding rotational speed of the drill string 112 may be measured un a rotational speed sensor 116A, which may be in signal communication with a computer in a surface logging, recording and control system 152 (explained further below). The drill string 112 may be suspended fin the wellbore 111 from a hook 118, attached to a traveling block (also not shown), through the kelly 117 and a rotary swivel 119 which permits rotation of the drill string 112 relative to the hook 118 when the rotary table 116 is operates. As is well known, a top drive system (not shown) may be used in other embodiments instead of the rotary table 116, kelly 117 and swivel rotary 119.

Drilling fluid ("mud") 126 may be stored in a tank or pit 127 disposed at the well site. A pump 129 moves the drilling fluid 126 to from the tank or pit 127 under pressure to the interior of the drill string 112 via a port in the swivel 119, which causes the drilling fluid 126 to flow downwardly through the drill string 112, as indicated by the directional arrow 158. The drilling fluid 126 travels through the interior of the drill string 112 and exits the drill string 112 via ports in the drill bit 155, and then circulates upwardly through the annulus region between the outside of the drill string 112 and the wall of the borehole, as indicated by the directional arrows 159. In this known manner, the drilling fluid lubricates the drill bit 155 and carries formation cuttings created by the drill bit 155 up to the surface as the drilling fluid 126 is returned to the pit 127 for cleaning and recirculation. Pressure of the drilling fluid as it leaves the pump 129 may be measured by a pressure sensor 158 in pressure communication with the discharge side of the pump 129 (at any position along the connection between the pump 129 discharge and the upper end of the drill string 112). The pressure sensor 158 may be in signal communication with a computer forming part of the surface logging, recording and control system 152, to be explained further below.

The drill string 112 typically includes a BHA 151 proximate its distal end. In the present example embodiment, the BHA 151 is shown as having a measurement while drilling (MWD) module 130 and one or more logging while drilling (LWD) modules 120 (with reference number 120A depicting a second LWD module 120). As used herein, the term "module" as applied to MWD and LWD devices is understood to mean either a single instrument or a suite of multiple instruments contained in a single modular device. In some embodiments, the BHA 151 may include a "steerable" hydraulically operated drilling motor of types well known in the art, shown at 150, and the drill bit 155 at the distal end.

The LWD modules 120 may be housed in one or more drill collars and may include one or more types of well logging instruments. The LWD modules 120 may include capabilities for measuring, processing, and storing information, as well as for communicating with the surface equipment. By way of example, the LWD module 120 may include, without limitation one of a nuclear magnetic resonance (NMR) well logging tool, a nuclear well logging tool, a resistivity well logging tool, an acoustic well logging tool, or a dielectric well logging tool, and so forth, and may include capabilities for measuring, processing, and storing information, and for communicating with surface equipment, e.g., the surface logging, recording and control unit 152.

The MWD module 130 may also be housed in a drill collar, and may contain one or more devices for measuring characteristics of the drill string 112 and drill bit 155. In the present embodiment, the MWD module 130 may include one or more of the following types of measuring devices: a weight-on-bit (axial load) sensor, a torque sensor, a vibration sensor, a shock sensor, a stick/slip sensor, a direction measuring device, and an inclination and geomagnetic or geodetic direction sensor set (the latter sometimes being referred to collectively as a "D&I package"). The MWD module 130 may further include an apparatus (not shown) for generating electrical power for the downhole system. For example, electrical power generated by the MWD module 130 may be used to supply power to the MWD module 130 and the LWD module(s) 120. In some embodiments, the foregoing apparatus (not shown) may include a turbine-operated generator or alternator powered by the flow of the drilling fluid 126. It is understood, however, that other electrical power and/or battery systems may be used to supply power to the MWD and/or LWD modules.

In the present example embodiment, the drilling and measurement system may include a torque sensor 159 proximate the surface. The torque sensor 159 may be implemented, for example in a sub 160 disposed proximate the top of the drill string 112, and may communicate wirelessly to a computer (see FIG. 11) in the surface logging, recording and control system 152, explained further below. In other embodiments, the torque sensor 159 may be implemented as a current sensor coupled to an electric motor (not shown) used to drive the rotary table 116. In the present example embodiment, an axial load (weight) on the hook 118 may be measured by a hookload sensor 157, which may be implemented, for example, as a strain gauge. The sub 160 may also include a hook elevation sensor 161 for determining the elevation of the hook 118 at any moment in time. The hook elevation sensor 161 may be implemented, for example as an acoustic or laser distance measuring sensor. Measurements of hook elevation with respect to time may be used to determine a rate of axial movement of the drill string 112. The hook elevation sensor may also be implemented as a rotary encoder coupled to a winch drum used to extend and retract a drill line used to raise and lower the hook (not shown in the Figure for clarity). Uses of such rate of movement, rotational speed of the rotary table 116 (or, correspondingly the drill string 112), torque and axial loading (weight) made at the surface and/or in the MWD module 130 may be used in one more computers as will be explained further below.

The operation of the MWD and LWD instruments of FIG. 1 may be controlled by, and sensor measurements from the various sensors in the MWD and LWD modules and the other sensors disposed on the drilling and measurement unit described above may be recorded and analyzed using the surface logging, recording and control system 152. The surface logging, recording and control system 152 may include one or more processor-based computing systems or computers. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for processing data received at the surface from the BHA 155 (e.g., as part of an inversion to obtain one or more desired formation parameters), and from the other sensors described above associated with the drilling and measurement system. The surface logging, recording and control system 152 may include one or more computer systems as will be explained with reference to FIG. 11. The other previously described sensors including the torque sensor 159, the pressure sensor 158, the hookload sensor 157 and the hook elevation sensor 161 may all be in signal communication, e.g., wirelessly or by electrical cable with the surface logging, recording and control system 152. Measurements from the foregoing sensors and some of the sensors in the MWD and LWD modules may be used in various embodiments to be further explained below.

Figure 2:
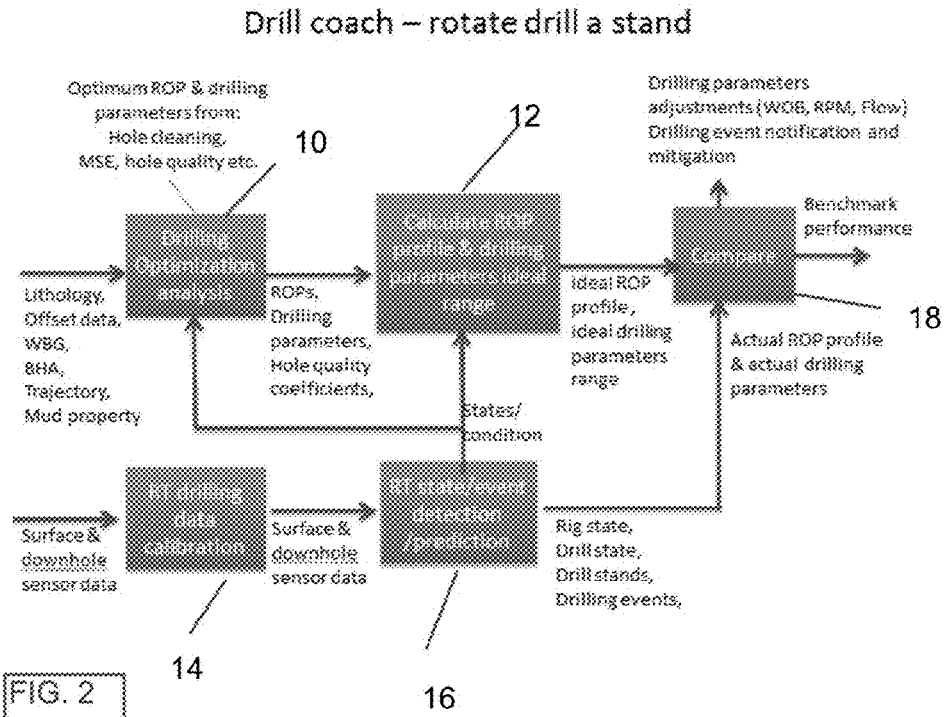
FIG. 2 is a flow chart showing calculating optimum drilling operating parameters and comparing them to actual drilling operating parameters during rotating drilling operations.

FIG. 2 shows a flow chart of an example implementation of calculating optimum drilling operating parameters and corresponding drilling response parameters, measuring actual drilling operating parameters and drilling response parameters, and comparing the calculated and measured parameters for actual performance optimization and/or performance benchmarking. The flow chart in FIG. 2 is during "rotating drilling", wherein the drill string (112 in FIG. 1) with the drill bit (155 in FIG. 1) at the lower end thereof may be rotated from the surface or may have selected portions thereof rotated by a drilling motor such as an hydraulic motor. At 10, optimum drilling operating parameters may be calculated. Input to the computer (FIG. 12) to perform such calculations may include, without limitation, formation mineral composition and mechanical properties (obtained from a nearby [offset] wellbore or from measurements made during drilling flithologyl), any available offset data, WBG is a wellbore schematic, or wellbore profile. WBG may include all the planned wellbore sections to be drilled, the target length of each wellbore section and the size, whether the wellbore section will be cased or not (a cased hole section might not have any effect on ROP in open formations, but it is required information to calculate the torque, drag and drilling fluid hydraulics of the open hole section below it to be drilled), bottom hole assembly (BHA) configuration, i.e., the mechanical properties of the drilling tools disposed proximate the lower end of the drill string, planned wellbore trajectory, and fluid properties of the drilling fluid ("mud"). At 12, a "profile" for one or more segments of the wellbore may be calculated in the computer. The profile may represent values with respect to depth in the wellbore of the optimum drilling operating parameters and drilling response parameters. The profile may be used by the computer (e.g., in unit 152 in FIG. 1) to generate a display for drilling personnel as will be explained with reference to FIG. 6. The profile may be used in the computer in a comparator function, at 18. During rotating drilling, the drilling operating parameters and drilling response parameters may be measured at 14 and profiled at 16. The profiled measured parameters may be entered into the comparator at 18 and be displayed and/or used for benchmark analysis, as will be further explained with reference to FIG. 7.

Figure 3:
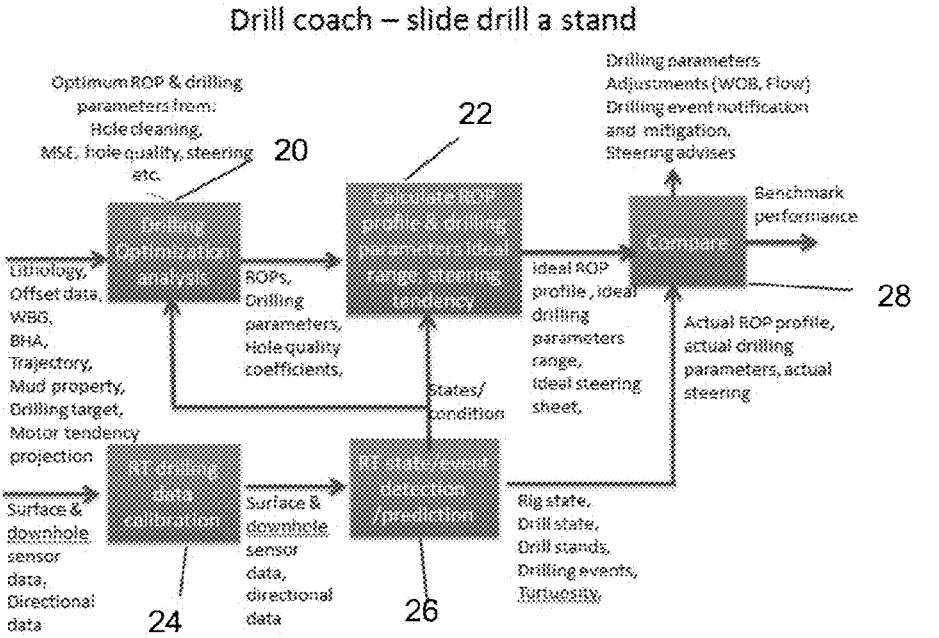
FIG. 3 is a flow chart showing calculating optimum drilling operating parameters and comparing them to actual drilling operating parameters during "sliding" drilling operations using a drilling motor called a "steerable motor."

FIG. 3 shows a flow chart of a similar implementation that may be used during slide drilling. Slide drilling is performed by holding the drill string (112 in FIG. 1) rotationally fixed at the surface and using the motor (150 in FIG. 1) to rotate the drill bit (155 in FIG. 1). Slide drilling is typically used with a steerable drilling motor, which has a bend in the motor housing. The direction of a plane intersecting the maximum angle of the housing bend is known as the "toolface" angle. During slide drilling, the wellbore trajectory tends to turn in the direction of the toolface angle, thus enabling adjustment to the wellbore trajectory as required by a wellbore design. The calculation of optimum drilling operating and drilling response parameters 20, profiling thereof 22 and entry into the comparator 28 may be similar to those described above with reference to FIG. 2, with the addition of calculating optimum trajectory change (so that the actual well trajectory most closely matches a predetermined trajectory according to the wellbore design or "well plan") and optimum rotational orientation (i.e., the toolface angle) of the steerable drilling motor if such is used to adjust the trajectory of the wellbore. The measured drilling operating and response parameters at 24 in the present example embodiment may include measurements of inclination and geomagnetic (or geodetic) azimuth of the wellbore and the rotary orientation (TF) of the drill string and consequently the toolface angle of the steerable drilling motor. The measurement data are profiled at 26 and at 28 may be entered into the comparator in the computer for display and/or benchmarking substantially as explained with reference to rotating drilling (FIG. 2).

Figure 4:
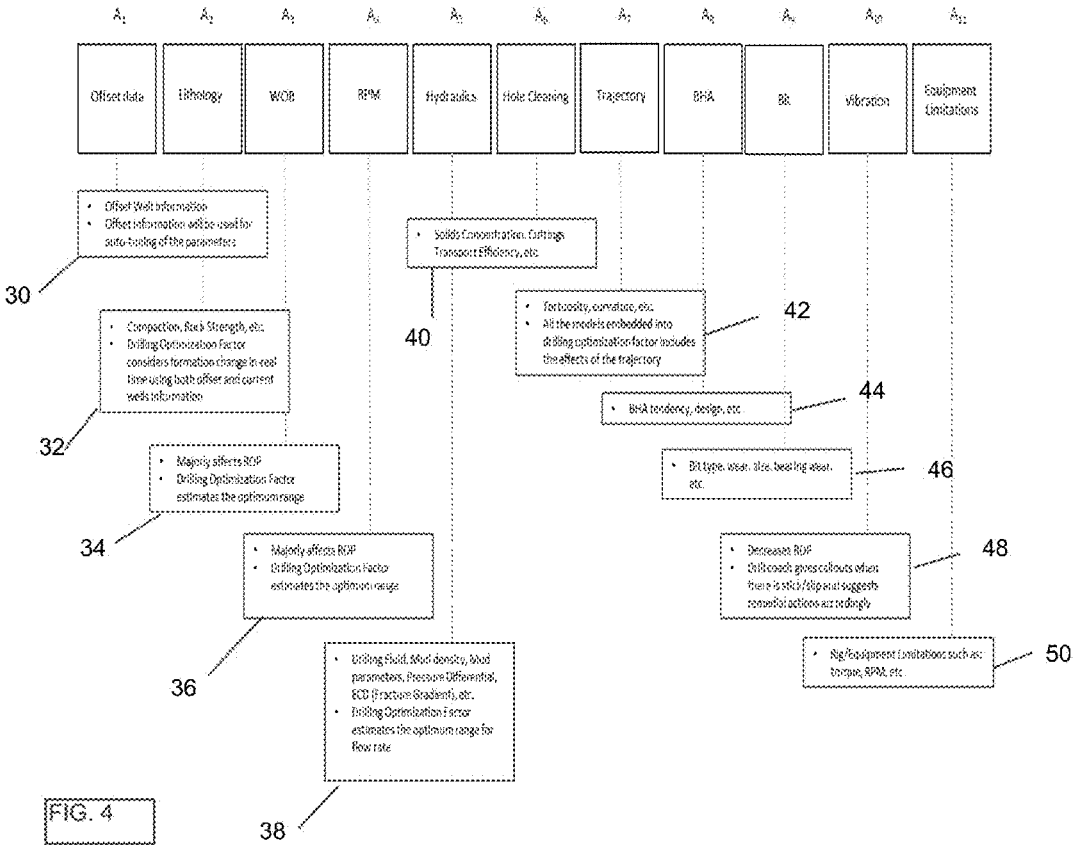
FIG. 4 shows a chart defining a plurality of variables that may be entered into a computer to calculate optimum drilling operating parameters resulting in optimized drilling response parameters.

Calculating the optimum drilling operating parameters and drilling response parameters may be better understood with reference to FIG. 4. Optimizing drilling operating and response parameters may be characterized as a function of such parameters.

$$\text{Drilling Optimization} = f\left(\begin{array}{c}\textit{Lith.}, \textit{WOB}, \textit{RPM}, \text{Hydraulics, Hole Cleaning,}\\ \text{Trajectory, } \textit{BHA}, \text{Bit, Vibration, Equipment Limitations}\end{array}\right)$$

The foregoing may be represented by selected variables:

$$\text{Drilling Optimization} = f(A_1, A_2, A_3, A_4, A_5, A_6, A_7, A_8, A_9, A_{10})$$

Optimum rate of penetration "ROP" (wherein ROP is the rate at which the wellbore is axially elongated) can be derived from the information input into the computer system. A general equation may be defined as:

$$\text{ROP} = c_1 \cdot A_1 + c_2 \cdot A_2 + c_3 \cdot A_3 + c_4 \cdot A_4 + c_5 \cdot A_5 + c_6 \cdot A_6 + c_7 \cdot A_7 + c_8 \cdot A_8 + c_9 \cdot A_9 + c_{10} \cdot A_{10}$$

wherein the "c" values are coefficients, which can be either constants or functions. In FIG. 4, the variables may be, for example, $A_1$ through $A_{10}$. Definitions of each variable are described in FIG. 4 in the boxes set forth as follows. $A_1$ may be lithology at 32. $A_2$ may be WOB, at 34. $A_3$ may be RPM at 36. RPM may be measured at the surface if the drill bit at the end of the drill string is rotated by the drill string from the surface, or may be estimated if the bit is rotated by a drilling motor (150 in FIG. 1) in the drill string. $A_4$ may be mud hydraulics at 38, including parameters, for example, viscosity, filtrate loss rate and density. $A_5$ may be a well cleaning (drill cuttings transport) indicator at 40. $A_6$ may be the planned wellbore trajectory at 42. $A_7$ may be the configuration of the bottom hole assembly ("BHA"—151 in FIG. 1) at 44, which term is understood to mean the drill collars, stabilizers, measurement while drilling tools, logging while drilling tools and other devices disposed in tubular elements having a larger outside diameter than the drill pipe as explained with reference to FIG. 1. $A_8$ may be the configuration of the drill bit, at 44. $A_9$ may be a drill string vibration characterization, at 48. The vibration characterization may be obtained by either or both surface measurements of WOB and torque or measurements from sensors in the MWD module (130 in FIG. 1) which measure, e.g., acceleration along selected directions. $A_{10}$ may represent the physical limitations of the drilling system, BHA and/or motor as to applicable torque, weight and RPM.

The coefficients in the above equation may be initialized as follows. If the wellbore is a subsequent well drilled in a particular geologic area, any available nearby ("offset") well data from the same geologic area may be used to estimate the initial values for the coefficients. If the well being drilled is the first well drilled in a particular geologic area, cumulative data stored in the computer may be used to initialize the coefficients. Contemporaneously with initialization of the coefficients, theoretical calculations or measurements for every parameter $A_1, A_2, \ldots A_{10}$ may be conducted. From the theoretical calculations and from parameter measurements, the system can determine the maximum, minimum and current values for the each parameter. For example, the maximum and minimum RPM may be determined using the theoretical estimations and the current RPM measurement will be made. As a second example, the maximum and minimum values of the vibration parameter may be determined for an optimized drilling operation and the current vibration parameter will be estimated through measurements of hookload, WOB and torque. In another example, lithology information may be obtained from an offset wells or if the drill string includes any form of while drilling formation evaluation sensor, or if any other form of well log measurements are available measurements therefrom related to lithology may be input as part of the parameter $A_1$. If there is any information concerning formation hardness, compaction, etc. the computer system will use that information as well to determine the $A_1$ model.

A similar procedure may be followed for the rest of the parameters. Models for each parameter may be determined. The determination of the models will depend on how much data related to each parameter is available to the computer system. The computer system will still initialize with simpler models for a given number of data. Then, minimum, maximum and predicted ROP will be calculated. Then, using the measured ROP value, the coefficients may be auto-tuned during actual wellbore drilling. The auto-tuning may be conducted to better match the predicted ROP to measured ROP. Then, the coefficients will be better characterized as the wellbore drilling progresses. For example, predicted and measured ROP matches; WOB decreases by a certain amount, ROP decreases a corresponding certain amount, the system will determine the sensitivity of ROP change with respect to WOB change. A similar approach may be used for the rest of the parameters to better determine the dependency of ROP on each parameter.

The foregoing parameters, which may include both measurements and/or theoretical estimations with corresponding models and/or corollaries from offset wells, may be used by the computer system to calculate a minimum desirable value, a maximum desirable value and a predicted optimum value of ROP substantially in real-time using the above equation, for example. A minimum desirable value may be established using the minimum of the optimum range for one parameter and such procedure may be extended to all the foregoing parameters. The above equation may then be used for the ROP determination. The same procedure can be followed for the maximum desirable values. For the predicted ROP, measurements of actual ROP may also be included into the above equation for auto-tuning coefficients during the drilling.

Figure 5:
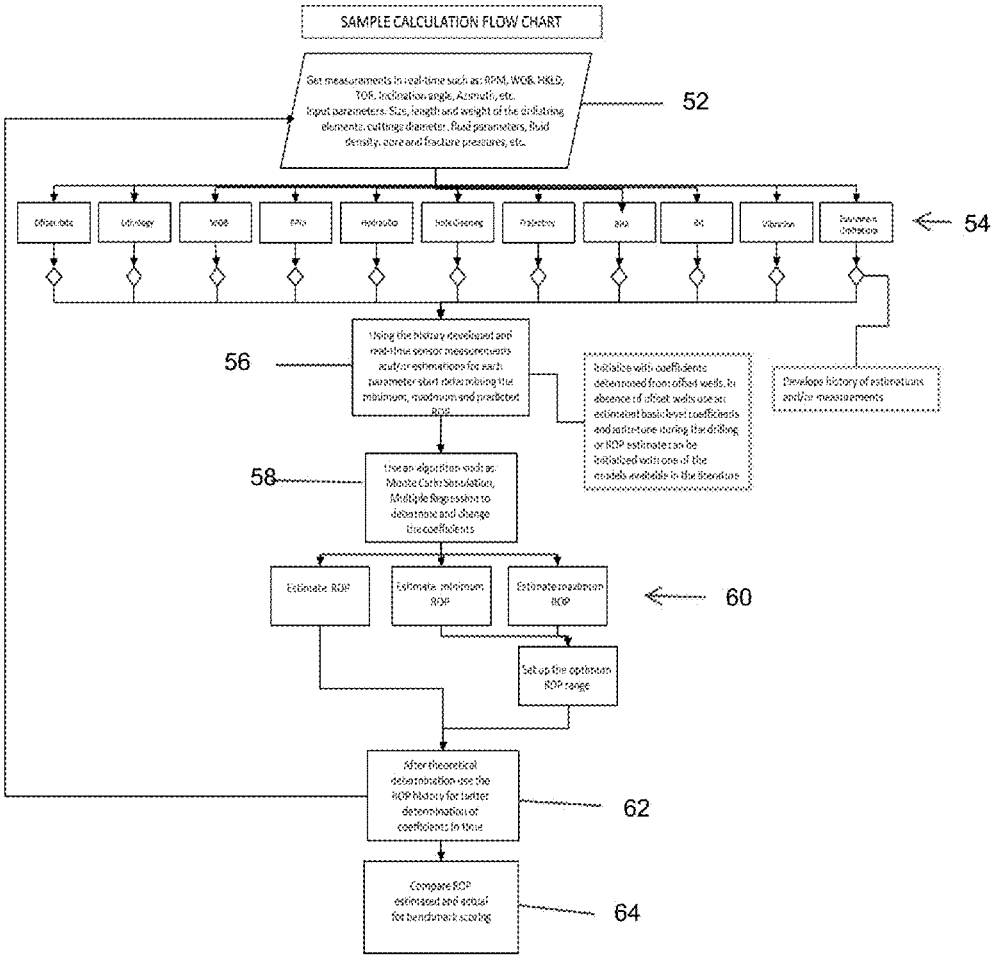
FIG. 5 shows a flow chart of an example method for calculating optimized drilling operating parameters in a computer.

An example calculation method for ROP ranges and optima is shown in a flow chart in FIG. 5. At 52, measurements may be obtained for measurements in real-time such as: RPM, WOB, weight supported by the drilling unit (hookload), torque, wellbore inclination angle and azimuth, etc. At 54, the foregoing measurements may be used to obtain values of any or all of the foregoing parameters as explained with reference to FIG. 3. At 56, coefficients of the equation described above may be initialized using offset well information if no measurements are yet available. The offset well information and any measurements may be entered into the computer. The computer may be programmed to use the measurements when obtained, as well as offset well data to calculate trends in the various measurements. Calculating trends may be performed, for example, using a method described in U.S. Patent Application Publication No. 2011/0220410 filed by Aldred et al. The foregoing method may also be used to predict expected values of any parameters processed at a selected axial distance from a present axial position of the drill string within the wellbore. Using the history (trends) developed, current parameter measurements and/or estimations for each parameter, start a minimum, maximum and predicted ROP may be calculated. At 58, an algorithm such as Monte Carlo Simulation or Multiple Linear Regression may be used to determine new values for and change the coefficients in the above equation.

At 60, the new coefficients may be used to calculate a minimum desirable ROP, a maximum desirable ROP and an optimum ROP (thus establishing a range of ROP values). The calculated ROP range and optimum value at each depth along a selected depth interval may be used by the computer system to generate a display (explained below with reference to FIG. 6.

At 62, the actual ROP measured during drilling may be compared to the calculated optimum ROP to adjust the coefficients of the above equation. The ROP minimum, maximum and optimum may be recalculated using the adjusted coefficients. At 64, the calculated ROP values may be compared to the actual measured ROP values as explained with reference to FIG. 2 for display to drilling personnel for adjusting drilling operating parameters to cause the ROP to more closely match the calculated ROP and for benchmarking.

The foregoing equation and methods for calculating optimum ROP therefrom take into account that the optimum ROP may not be the maximum ROP obtainable in any particular set of drilling conditions. For example, the method disclosed in Canadian Patent No. 2,324,233 cited in the Background section herein continuously calculates a WOB that causes the ROP to be continuously maximized if the drilling unit is operated to maintain the calculated WOB. However, such maximized ROP may, under some drilling conditions, result in excessive deviation from the planned wellbore trajectory, excessive vibration leading to drilling tool failure or may result in the drill string becoming stuck in the wellbore because of insufficient transport of drill cuttings to the surface ("pack off").

The same procedure to calculate ranges and optimum values for ROP over a selected depth interval (or the entire wellbore) may be similarly performed for all drilling operating parameters (e.g., hookload, RPM and drilling fluid pumping rate). Similarly, ranges and optimum values for drilling response parameters may be calculated.

Figure 6:
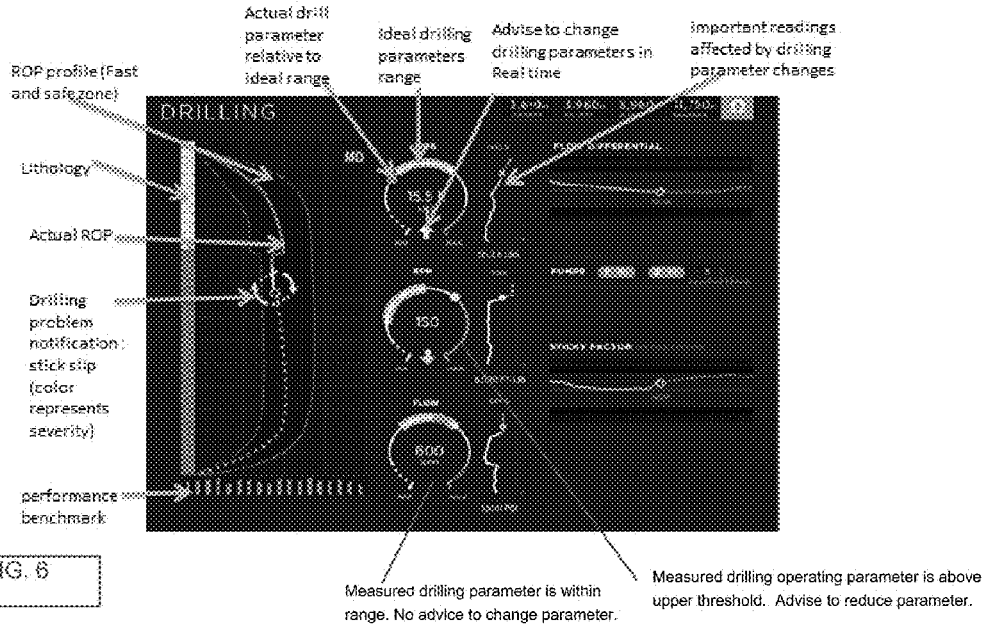
FIG. 6 shows an example display generated by the computer which may be observed and used by drilling personnel to assist in selection of optimum drilling operating parameters.

FIG. 6 shows an example display that may be generated by the computer and presented, for example to the drilling unit operator ("driller") in order that an optimum set of drilling operating parameters is maintained to result in optimum ROP being maintained during rotary drilling. The display may include a plot of the ROP range and the measured ROP, such that the driller may adjust the drilling operating parameters to maintain the measured ROP within the ROP range, and preferably at the optimum ROP. Other parameters that may be displayed are explained in FIG. 6, and may include, in some embodiments, weight on the drill bit (WOB), drill bit rotation speed (RPM) and drilling fluid flow rate (GPM). Each of the parameters displayed may include calculated lower and upper threshold values displayed as a range as shown in FIG. 6 and the measured values as a point or other symbol. When a measured value exceeds the upper threshold or falls below the lower threshold, an indication may be provided to the display to adjust the parameter so as to fall within the range between the lower and upper thresholds. If the measured parameter value is within the range, no change action is displayed.

An alarm indicator may be generated if any one or more of the drilling operating parameters or drilling response parameters falls outside the calculated range. In such event, the display may show both the cause of the alarm and a suggested corrective action to be taken by the driller to cause the out of range parameter to return to within the range. Examples of alarm indicators and corrective actions may include, without limitation:

a) Offset-1: Decreased ROP due to Hole Cleaning @ 60 RPM, Increase RPM, Increase Flow Rate.

b) Offset-2: Severely Decreased ROP due to low WOB @ WOB:5k, Increase WOB.

c) Offset-3: Decreased ROP due to High Vibration @ Vibration Parameter: 87, Stay in the RPM Range.

d) Offset-4: Formation Change Approaching e) Offset-5: Above the ROP range, followed by pack-off and loss circulation, Stay in the ROP Range by reducing RPM or WOB.

Figure 7:
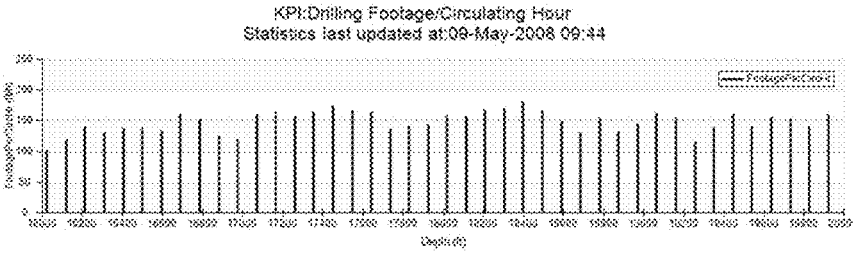
FIG. 7 shows an example display generated by the computer that may be used in comparing actual drilling performance to selected benchmark performance criteria.

FIG. 7 shows an example of a performance benchmark display that may be made to appropriate personnel associated with construction of the wellbore. The example shown in FIG. 7 is length of wellbore drilled per unit time with the drilling unit mud pumps active (circulating hours). Other benchmark criteria will occur to those skilled in the art, for example and without limitation, time at optimum ROP with respect to total drilling time, drilling time outside the predetermined ROP range, amount of time any drilling operating parameter is maintained outside predetermined limits.

Figure 8:
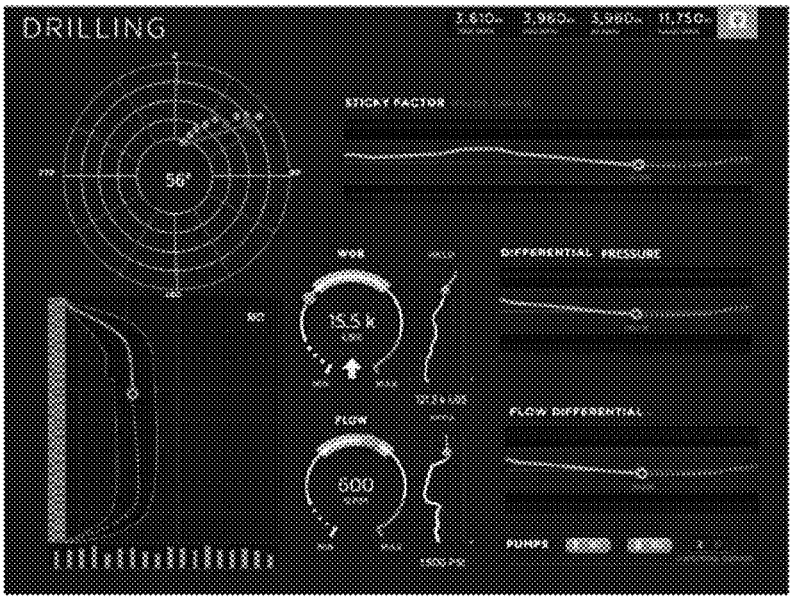
FIG. 8 shows another example display similar to the one shown in FIG. 7 but during "slide" drilling with a steerable motor.

FIG. 8 shows an example display similar to that of FIG. 6, but for slide drilling with a steerable drilling motor. The display in FIG. 8 may include substantially all the same parameters as the display in FIG. 6, and may further include a wellbore azimuth (geomagnetic or geodetic direction) plot, shown in polar coordinate form in FIG. 8 and including measured wellbore azimuth and planned wellbore azimuth. It is to be clearly understood that the form of displays presented herein are only meant to serve as examples and are not intended to limit the scope of what drilling operating parameters and drilling response parameters may be displayed consistent with the scope of the present disclosure.

Figure 9:
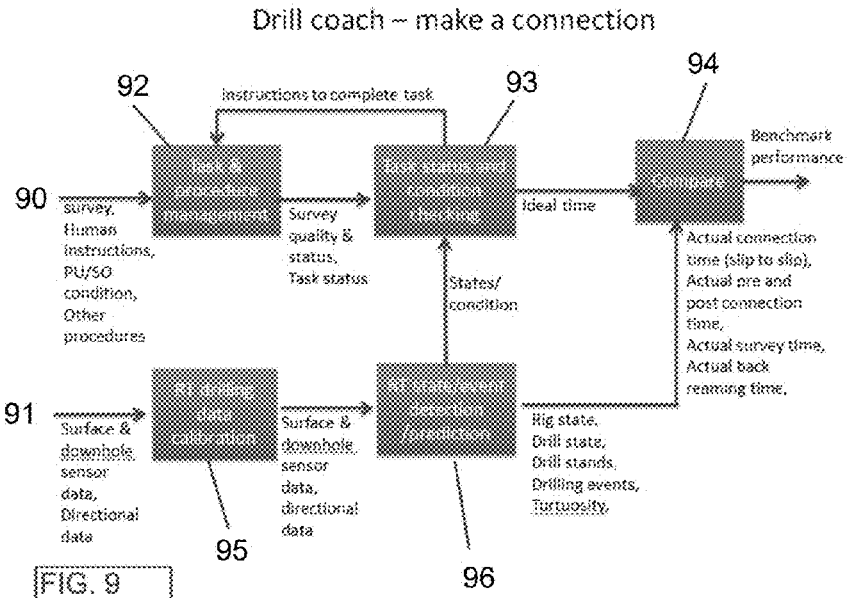
FIG. 9 shows a flow chart for an example method for calculating optimum operating parameters for connecting additional segments (joints or stands) of pipe or drilling tools to the drill string ("making a connection").
Figure 10:
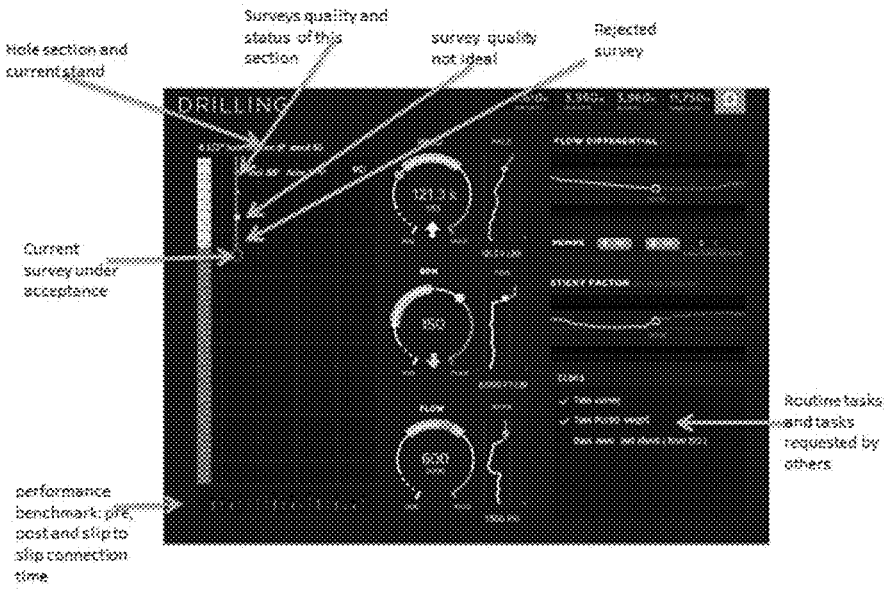
FIG. 10 shows an example display generated in the computer for performance indication during making connections.

FIG. 9 shows a flow chart of a procedure for estimating optimum drilling operating parameters and measuring drilling operating parameters during a connection procedure (as explained above). At 90, instructions for one or more drilling procedures, e.g., making a connection (assembling a joint or stand of drill pipe or drilling tools to the drill string), may be entered into the computer system. At 92, the computer system may generate a set of optimized drilling tasks and optimized drilling operating parameters for executing the instructions entered at 90. At 91 as the drilling tasks are initiated, signals from various sensors such as explained with reference to FIG. 1 may be communicated to the computer system. The sensor data may be calibrated or normalized at 95. At 96, a real-time well state may be calculated by the computer system. An expected well state at each moment in time predicted from the optimized drilling operating parameters may be generated in the computer system at 93. At 94, the actual well state may be compared to the predicted well state. Any form of suitable display may be provided to the driller so that the actual drilling operating parameters may be selected to most closely match the calculated optimum parameters. An example of such a display is shown in FIG. 10. It is often the case during a connection operation prior to resuming drilling that a wellbore trajectory ("directional") survey is made. Quality of any particular survey may be determined automatically by the computer and shown on the display.

Figure 11:
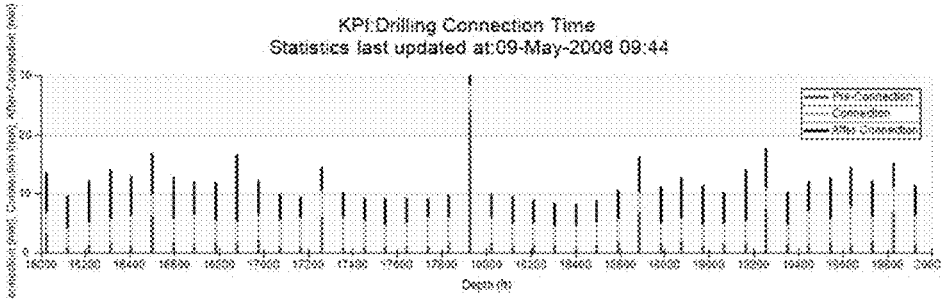
FIG. 11 shows an example display generated by the computer that may be used in comparing actual connection performance to selected benchmark performance criteria.

FIG. 11 shows one example of a benchmarking display that may be generated by the computer system and used to drive a display provided to suitable personnel associated with construction of the wellbore. The example display in FIG. 11 shows, for each connection, an amount of time elapsed from: (i) cessation of operation of the drilling unit mud pumps (129 in FIG. 1) to initiation of connecting a segment to the drill string; (ii) an amount of time making the segment of connection to the drill string; and (iii) an amount of time from completion of the connection to resumption of drilling the wellbore. Other types of displays will occur to those skilled in the art, including, without limitation, measured torque applied to each connection compared to a predetermined optimum torque for each connection, peak startup SPP after connection compared with a predetermined peak SPP for each connection, measured overpull to lift the drill string off the bottom of the well for each connection compared to predetermined overpull.

Figure 12:
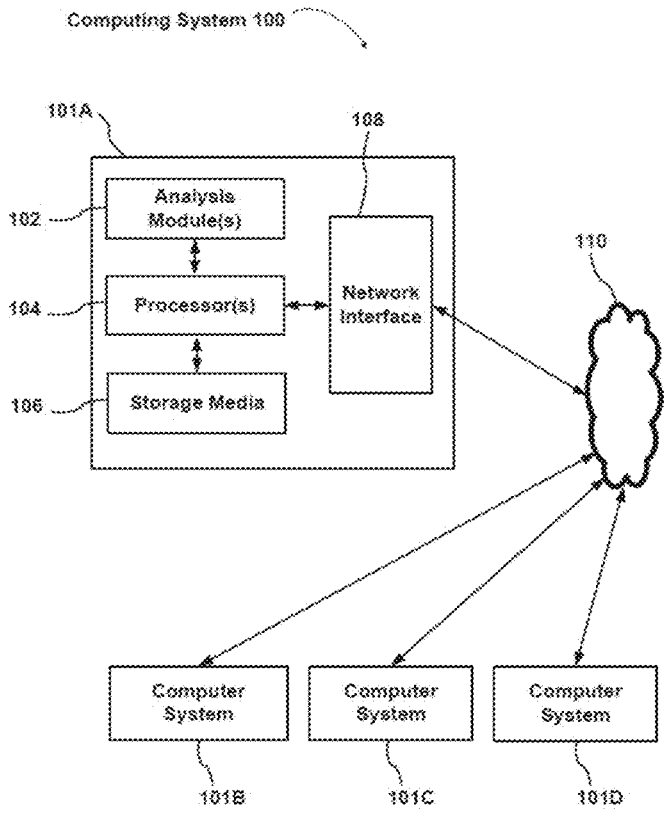
FIG. 12 shows an example computer system that may be used in connection with methods according to the present disclosure.

FIG. 12 shows schematically an example computing system 100 in accordance with some embodiments. The computing system 100 may be an individual computer system 101A or an arrangement of distributed computer systems. The computer system 101A may include one or more analysis modules 102 that may be configured to perform various tasks according to some embodiments, such as the tasks depicted in FIGS. 2 through 11. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at the well drilling location, while in communication with one or more computer systems such as 101C and/or 101D that may be located in one or more data centers on shore, aboard ships, and/or located in varying countries on different continents).

A processor can include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 12 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 12, and/or computing system 100 may have a different configuration or arrangement of the components depicted in FIG. 12. The various components shown in FIG. 12 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for optimizing drilling, comprising:

initializing values of a plurality of drilling operating parameters, the drilling operating parameters being controllable by a drilling unit operator;

in a computer, determining an initial relationship between the plurality of drilling operating parameters and a drilling response parameter;

determining a predicted value for the drilling response parameter based on the initial relationship and the initialized values of the plurality of drilling operating parameters;

measuring values of the plurality of drilling operating parameters and a value of the drilling response parameter during drilling;

comparing the measured value of the drilling response parameter to the predicted value for the drilling response parameter;

updating the relationship between the drilling response parameter and the plurality of drilling operating parameters based on the comparison;

in the computer, using the updated relationship, determining a range of values, comprising a maximum optimum value, a minimum optimum value, and a predicted optimum value for the drilling response parameter, wherein the maximum value is not equal to the predicted optimum value, and a range of values and an optimum value of at least one of the plurality of drilling operating parameters using the updated relationship; and in the computer, generating a display of the at least one of the plurality of drilling operating parameters and the drilling response parameter.

2. The method of claim 1 further comprising in the computer, determining trends in the ranges and optimum values and generating a display of the ranges and optimum values for a selected distance beyond an end of the well bore.

3. The method of claim 2 further comprising operating the drilling unit to maintain the at least one of the plurality of drilling operating parameters substantially at the displayed optimum value during drilling to the end of the well bore.

4. The method of claim 1 further comprising operating the drilling unit to maintain the at least one of the plurality of drilling operating parameters substantially at the displayed optimum value.

5. The method of claim 1 further comprising measuring an amount of time that the drilling unit is operated: outside the range of values of the at least one drilling operating parameter; within the range of values of the at least one drilling operating parameter; and substantially at the optimum value of the at least one drilling operating parameter.

6. The method of claim 1 wherein the drilling operating parameters comprise at least one of an axial force applied to a drill bit, a rotational speed of the drill bit, a rate of pumping drilling fluid into a drill string, a configuration of a bottom hole assembly and hydraulic properties of the drilling fluid.

7. The method of claim 1 wherein the drilling response parameter is selected from the group consisting of: rate of axial elongation of the wellbore, wellbore trajectory, pressure of pumping the drilling fluid, torque applied to a drill string or to a drill bit, drill string vibration and rate of transport of drill cuttings to surface from a bottom of the wellbore.

8. The method of claim 7 further comprising comparing a measured wellbore trajectory with reference to a predetermined wellbore trajectory and displaying the measured trajectory, the predetermined trajectory and a corrective action when a deviation between the measured trajectory and the predetermined trajectory exceeds a selected threshold.

9. The method of claim 1 wherein the initializing further comprises obtaining data from a wellbore proximate the wellbore being drilled.

10. The method of claim 9 wherein the obtained nearby wellbore data comprises formation composition with respect to depth, at least one drilling operating parameter with respect to depth and at least one drilling response parameter with respect to depth.

11. The method of claim 1 further comprising displaying an alarm indicator when the at least one measured drilling operating parameter or the at least one drilling response parameter is outside the respective range.

12. The method of claim 11 further comprising displaying a corrective action to be applied to the at least one measured drilling operating parameter to cause the at least one drilling operating parameter and/or the at least one drilling response parameter to return to within the respective range.

13. The method of claim 1 further comprising measuring an amount of time from stopping drilling to make a connection to having the drill string supported for making the connection; an amount of time to make the connection and an amount of time from an end of making the connection to resuming drilling the well bore.

14. The method of claim 13 further comprising measuring the amount of time from stopping drilling to make the connection to having the drill string supported for making the connection; the amount of time to make the connection and the amount of time from the end of making the connection to resuming drilling the well bore for each connection made during the wellbore and comparing the measured times to benchmark times for corresponding connection activities.

15. The method of claim 1 wherein the initialized values comprise data from a wellbore proximate the wellbore being drilled.

16. The method of claim 15 wherein the nearby proximate well bore data comprise formation composition with respect to depth, at least one drilling operating parameter with respect to depth and at least one drilling response parameter with respect to depth.

17. The method of claim 1 further comprising displaying a corrective action to be applied to the at least one measured drilling operating parameter to cause the at least one drilling operating parameter and/or the at least one drilling response parameter to return to within the respective range.

18. The method of claim 1 further comprising measuring an amount of time from stopping drilling to make a connection to having the drill string supported for making the connection; an amount of time to make the connection and an amount of time from an end of making the connection to resuming drilling the well bore.

19. The method of claim 18 further comprising measuring the amount of time from stopping drilling to make the connection to having the drill string supported for making the connection; the amount of time to make the connection and the amount of time from the end of making the connection to resuming drilling the well bore for each connection made during the wellbore and comparing the measured times to benchmark times for corresponding connection activities.

20. A drilling optimization system, comprising:

a processor; and a non-transitory, computer-readable medium storing instructions that, when executed by the processor, causing the drilling optimization system to perform operations, the operations comprising:

initializing values of a plurality of drilling operating parameters, the drilling operating parameters being controllable by a drilling unit operator;

determining an initial relationship between the plurality of drilling operating parameters and a drilling response parameter;

determining a predicted value for the drilling response parameter based on the initial relationship and the initialized values of the plurality of drilling operating parameters;

measuring values of the plurality of drilling operating parameters and a value of the drilling response parameter during drilling;

comparing the measured value of the drilling response parameter to the predicted value for the drilling response parameter;

updating the relationship between the drilling response parameter and the plurality of drilling operating parameters based on the comparison;

using the updated relationship, determining a range of optimum values comprising a maximum value, a minimum value, and a predicted optimum value, for the drilling response parameter, wherein the maximum value is not equal to the predicted optimum value, and a range of values including an optimum value of at least one of the plurality of drilling operating parameters; and a display in signal communication with the processor to display at least one of the plurality of drilling operating parameters and the drilling response parameter and the range of optimum values thereof.

21. The system of claim 20 wherein the operations further comprise calculating trends in the ranges and optimum values and operating the display to show the ranges and optimum values for a selected distance beyond an end of the wellbore.

22. The system of claim 20 wherein the operations further comprise measuring an amount of time that a drilling unit is operated: outside the range of values of the at least one drilling operating parameter; within the range of values of the at least one drilling operating parameter; and substantially at the optimum value of the at least one drilling operating parameter.

23. The system of claim 20 wherein the drilling operating parameters comprise at least one of an axial force applied to a drill bit, a rotational speed of the drill bit, a rate of pumping drilling fluid into a drill string, a configuration of a bottom hole assembly and hydraulic properties of the drilling fluid.

24. The system of claim 20 wherein the drilling response parameter is selected from the group consisting of: rate of axial elongation of the well bore, well bore trajectory, pressure of pumping the drilling fluid, torque applied to a drill string or to a drill bit, drill string vibration and rate of transport of drill cuttings to surface from a bottom of the well bore.

25. The system of claim 24 wherein the operations further comprise comparing a measured well bore trajectory with reference to a predetermined well bore trajectory and to display the measured trajectory, the predetermined trajectory and a corrective action when a deviation between the measured trajectory and the predetermined trajectory exceeds a selected threshold.

26. The system of claim 20 wherein the operations further comprising generating an alarm indicator and communicating the alarm indicator to the display when the at least one measured drilling operating parameter or the at least one drilling response parameter is outside the respective range.

* * * * *